United States Patent [19]

Doyle

[11] Patent Number: 4,928,845

[45] Date of Patent: May 29, 1990

[54] END FACE WITH TEAR-OFF LIP CLOSURE FOR PRESSURIZED CONTAINER

[76] Inventor: Michael J. M. Doyle, Warmoesstraat 16P, 1012 3D Amsterdam, Netherlands

[21] Appl. No.: 259,258

[22] Filed: Oct. 18, 1988

[30] Foreign Application Priority Data

Oct. 19, 1987 [NL] Netherlands ..... 8705497

[51] Int. Cl.[5] ..... B65D 51/16

[52] U.S. Cl. ..... 220/271; 220/366; 220/373

[58] Field of Search ..... 220/366, 367, 373, 265–273

[56] References Cited

U.S. PATENT DOCUMENTS

| | | | |
|---|---|---|---|
| 3,485,410 | 12/1969 | Boik | 220/271 |
| 3,958,717 | 5/1976 | Ellis | 220/268 |
| 4,054,228 | 10/1977 | Balocca et al. | 220/268 |
| 4,134,517 | 1/1979 | Rhoades | 220/268 |
| 4,146,149 | 3/1979 | Beveridge | 220/271 |
| 4,196,823 | 4/1980 | Madden et al. | 220/268 |
| 4,205,759 | 6/1980 | Koller | 220/271 |
| 4,318,494 | 3/1982 | Heyn | 220/271 |
| 4,410,101 | 10/1983 | Vogt | 220/271 X |
| 4,537,326 | 8/1985 | Morehead | 220/269 |
| 4,674,649 | 6/1987 | Pavely | 220/271 |

FOREIGN PATENT DOCUMENTS 0220820 9/1986 European Pat. Off. .

*Primary Examiner*—Stephen Marcus
*Assistant Examiner*—Nova Stucker
*Attorney, Agent, or Firm*—Webb, Burden Ziesenheim & Webb

[57] ABSTRACT

The invention deals with an end face (1) with tear-away lip closure (3) for a pressurized container. Upon opening the tear-away lip (3), often the contents of the container are sprayed around because of the high internal pressure and the formation of foam after shaking the container. To remedy this disadvantage of known containers, a throttle device (5) for controlled release of the excess pressure is applied over the hole which is formed on tearing open the first section of the lip closure (3). This throttle device can be applied to both lip closures which are completely removed from the end face, as well as lip closures which stay attached to the end face and which are pushed into the inner space of the container.

9 Claims, 7 Drawing Sheets

END FACE WITH TEAR-OFF LIP CLOSURE FOR PRESSURIZED CONTAINER

The present invention relates to an end face for a can which can be under excess pressure on the inside and which is provided with a tear-away lip closure.

End faces of this type are used in can packaging for drinks containing carbon dioxide, such as soft drinks, beer and the like. Many different embodiments of the tear-away lip incorporated in such an end face are known. A first type of tear-away lip is constituted by that which forms a whole with the end face and which is delimited with respect to the rest of the end face by a weakening (score) line. The tear-away lip can be torn from the end face along the weakening (score) line by means of a ring pull.

A second type of lip consists of a plastic insert which is placed in the prepared opening of a metal end face. The insert has an edge which is fixed in the hole in the end face. The lip closure is connected by means of a weakening (score) line to the said edge so that it can be torn away. An embodiment of this type is known, for example from European Patent Application EP-A No. 0,220,820.

To remove the lip closures from the end face a certain force must be exerted on the ring pull. When this force is sufficiently large, the lip closure springs free from the end which is closest to the ring pull. As a result of the shock which accompanies this springing free, the lip closure tears open to a greater or lesser extent. By this means a definite opening is provided directly in the end face and can be enlarged by further pulling on the pull ring. If the contents of the container are pressurized, for example because it has been shaken just before opening, or also as a result of the shock which accompanies opening, the pressurized contents of gas, liquid and foam spray out of the initially formed opening. This is undesirable because some of the contents are lost as a result and can spray the surroundings. In addition, a more or less loud noise can be generated, such as a bang. It is not possible to avoid this by opening the container carefully since a more or less large initial opening is always obtained directly as a result of the shock on opening.

In the abovementioned Patent Application EP-A No. 220,820 an attempt was made to provide a solution to this problem by allowing the opening of the closure to proceed in two stages. During the first stage the closure can be torn open only over a restricted distance, after which tearing open is interrupted because a region with a greater material thickness at the location of the weakening line has to be torn open to open the remainder of the closure. By subsequently exerting a greater pull, this section can then also be torn open. The problem that a free passage is formed for the contents directly after tearing open the lip closure apparently arises with this known embodiment also, even though the size of said passage remains restricted. Despite this, the pressurized contents will spray out in this case also.

The aim of the present invention is, therefore, to provide an end face of the type mentioned in the preamble which possesses a safety feature against spraying of the contents outside during opening of the container. This aim is achieved according to the invention in that a throttle device for controlled release of the excess pressure extends over the hole which is formed on tearing open the first section of the lip closure.

The opening in the end face which is now formed directly after the lip closure springs free is covered by the throttle device, the outside of which is now in contact with the atmosphere. Because of the throttle action of this device, the internal over-pressure in the container can gradually decrease as gas and any foam are released to the outside in a controlled manner under the influence of said excess pressure. The noise generated is now also less. A small amount of liquid can flow out, but this occurs with so little force that this liquid remains on the end face. After a short time the internal pressure has fallen sufficiently to tear the lip closure further open without there being a danger that the free passage thus formed will give rise to the contents spraying out.

In view of the fact that the throttle device has to be present only in the section of the lip closure which is torn open during the initial phase of opening of the container, which is accompanied by a shock, a pour opening of sufficiently large dimensions can still be obtained on further tearing open of the lip closure. A device of this type can also be used on any closure, for example that which forms a whole with the end face or, as known from EP-A No. 220,820, in the form of an insert. Furthermore, the device can be applied to the push-in type closures.

According to an initial embodiment of the invention, provision is made that the throttle device extends over the inner region of the end face close to the first section of the lip closure and the region of the lip closure bordering this first section, throttle passages being located between the throttle device and one or both regions. The throttle passages can be obtained by providing either the throttle device or the end face (or both) with surface roughening, as a result of which a system of minuscule channels remains between the throttle device and the end face after attachment of said device to the end face.

According to a second embodiment of the invention provision is made that the throttle device is permeable and connected to the inner region of the end face close to the first section of the lip closure and also to the region of the lip closure bordering this first section so as to provide a seal. The throttle device is attached to the end face around the hole to be formed first, so as to provide a seal; the connection to the lip closure is such that it can be pulled loose from the throttle device. Because of the permeable character of the throttle device, the pressure can now be released straight through.

According to a first possibility, this can be achieved by the throttle device being porous. The desired throttle effect can be obtained by suitable choice of the porosity.

According to a second possibility of the invention, the permeable device can be provided with holes. The advantage of this embodiment is that the permeability, which is dependent on the number and the size of the holes, is readily reproducible. According to the invention the holes can run right through the device. However, it is also possible that the entire surface of the throttle device is attached to the lip closure and end face and the holes terminate a short distance from the lip closure such that when the lip closure is torn open the boundary layer of the throttle device attached thereto is pulled with it and the holes come into contact with the atmosphere.

According to a further embodiment of the invention, the throttle device consists of a first layer provided with holes and a solid second layer which is attached thereto and is also attached to the tear-away lip, such that when the tear-away lip is torn open the solid layer is pulled with the tear-away lip. The first layer can be larger than the second, so that, in this case, the projecting portions of this can be attached directly to the end face and tear-away lip.

Preferably, the throttle device consists of a material with elastic-plastic properties. An example would be a foamed "PVC" from the company W. R. Grace, compound number 6032E700CB. Also, crosslinked foamed polyethylene could be used. Both these materials have received approval from the F.D.A. for use in contact with food and beverages. With a material of this type the holes narrow as soon as the needles with which the holes were made are removed. In the extreme case they close again, although a "scar" remains which forms a hole again as soon as an overpressure arises on one side of the hole. An advantage of a material with this type of behaviour is that fairly thick needles can be used to produce relatively small holes. It must be taken into account that the diameter of the holes is important as if the holes are too large the liquid would still spray out in small jets if there is sufficient excess pressure.

In this respect, the invention can especially be applied to end faces provided with a tear-away lip closure of the kind which upon opening is being pushed into the inner space of the can. This kind of end face has become known recently; its advantage is that the torn open lip closure stays attached to the end face, thus avoiding the environmental problem associated with loose lip closures.

For this kind of end face and lip closure, preferably the attachment of the material of the throttle device to the corresponding surfaces of lip closure and the end face is strong enough to permit stretching of the material of the throttle device covering the hole during the first stage of opening of the lip closure.

Now upon opening the lip closure, the material of the throttle member is stretched, resulting in a controllable release of the overpressure depending on the extent of stretching.

If more rigid material is used, which lacks the characteristics described above, the throttle device is designed such that the throttle device consists of two layers which are connected to one another at the circumference and have holes which do not lie on one line, the layer adjoining the end face having a larger number of holes than the other.

The holes can now be relatively large, while a good throttle effect is still obtained. The liquid/gas mixture penetrates the throttle device through the relatively small number of holes in the first layer, is diverted and emerges into the atmosphere through the larger number of holes in the second layer.

Because of the difference between the total passage surfaces in the first and the second layer and also the diversion of the mixture, a good throttling effect is now still obtained.

According to the invention the end face can be produced by attaching a layer of plastic to the coating of the end face by means of melting under the influence of heat, or adding of a liquid, which is cured so that it becomes a solid which is bonded to the coating, after which the holes if required may be punched in the plastic by means of needles. Since the holes are made only after the throttle device has been firmly attached, there is no risk with regard to blockage of the holes during this attachment. It is possible that, as mentioned above, holes do not run completely through the plastic layer. An advantage of this is that the tool for making the holes then cannot come into contact with the coating, which could have an adverse effect on the quality and could damage the contents. In this case, the throttle device must be attached to the lip closure such that when the latter is torn off the upper layer of the throttle device is pulled with it and the holes are exposed.

If the throttle device consists of two layers of which only the layer facing away from the end face has holes, it is very simple to make the holes. The needles can now be pushed in until their points reach into the solid layer. By this means it is firstly ensured that the holes run clean through and would not be too small at the tip of the needle. Furthermore it is possible to work with wider tolerances when making the holes since the points of the needles are caught in the solid layer and do not impinge directly on the coating of the end face.

According to another manufacturing process, a liquid plastic is applied to the end face and cured, by which process the throttle device is formed. This liquid can contain a foaming agent, which during the curing process releases gas and forms a cellular structure in the resulting solid plastic. Depending on the procedure, this cellular structure can be closed in which case needles have to be used to make the holes, or the cellular structure can be open, in which case the resulting solid is porous.

The invention will be explained in more detail below with the aid of several exemplary embodiments.

FIGS. 1*a–b* show the end face according to the invention from the outside and inside respectively.

FIGS. 2*a–b* show the end face at the outside with, respectively, the lip closure torn away over the first section and virtually completely.

FIGS. 3*a–c* show cross-sections of the end face or uppermost part of a can with, respectively, closed, partially torn away and virtually completely torn away lip closure.

FIG. 4 shows a first preferred embodiment from the inside of the end face.

FIGS. 5*a–b* show a cross-section of the first preferred embodiment with, respectively, the lip closure closed and partially torn away during the first stage of opening.

FIGS. 6*a–b* show a cross-section of a second preferred embodiment with, respectively, the lip closure closed and torn away during the first stage of opening.

FIGS. 7*a–b* show a third preferred embodiment with the same views as in FIGS. 6*a–b*.

FIG. 8 shows a fourth preferred embodiment of the lip closure.

FIGS. 9*a–b* show a procedure for attaching a throttle device to the inside of the end face.

Figure 1A:
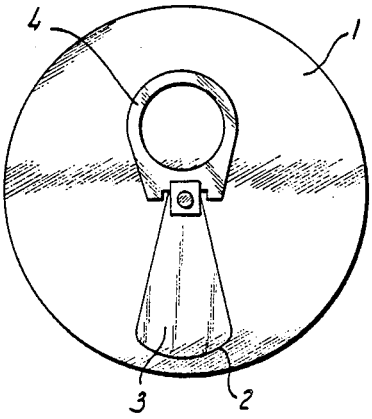
Figure 1B:
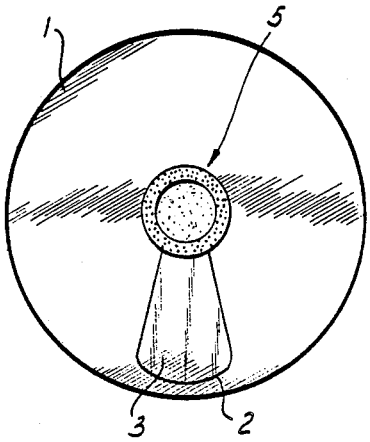
Figure 2A:
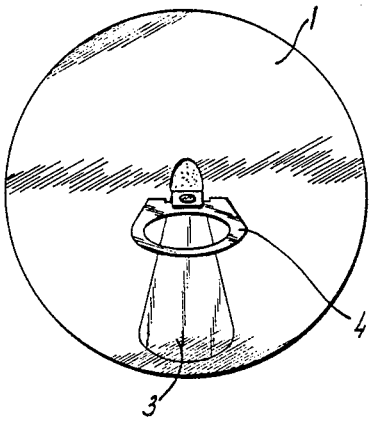
Figure 2B:
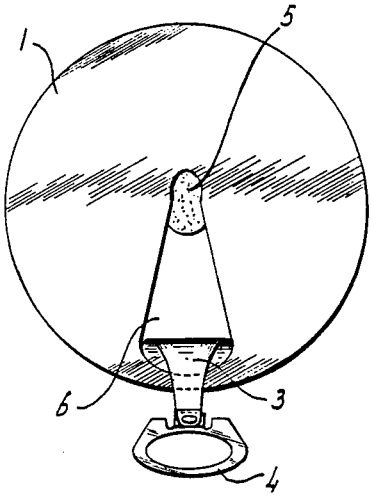

In FIGS. 1*a–b* an end face 1 of a can with contents under excess pressure, such as a drink containing carbon dioxide, is shown. A tear-away lip closure 3, which can be torn from the end face by means of a ring pull 4, is defined by the weakening line 2. A throttle device 5 is fitted on the section of the lip closure 3 and the adjacent inside of the end face 1 close to the ring pull 4. The throttle device is firmly attached at its circumference to the end face 1; the central region of the throttle device is not attached As shown in FIG. 2*a*, the lip closure is partially torn away during the first stage of opening of the can. The hole formed in the endface is, however, still covered by the porous throttle device 5, so that the internal excess pressure can drop in a controlled manner. The lip closure is then torn away completely, exposing the pour opening 6.

Figure 3A:
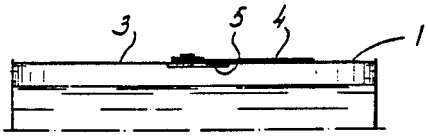
Figure 3B:
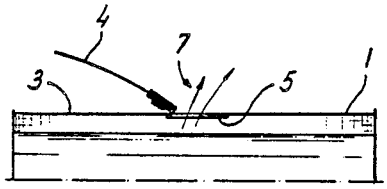
Figure 3C:
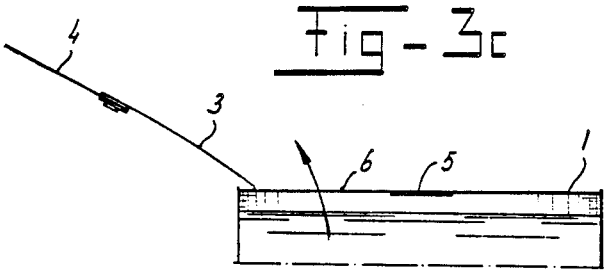

In FIGS. 3*a–c* the various features are again shown in cross-section. FIG. 3*b* shows the controlled escape of gas and any liquid which may be mixed therewith. As the complete circumference of the throttle device is attached to the inside of the end face, the gas cannot escape in any other way.

FIG. 3*c* shows the pour opening 6 formed when the lip closure 3 is torn away further. There is now no danger in respect of the contents spraying out as the internal excess pressure has been lowered in the previous phase of opening of the lip closure.

Figure 4:
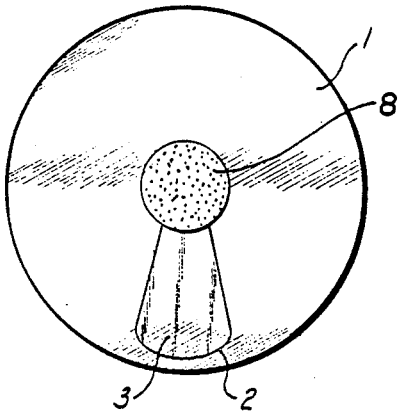
Figure 5A:
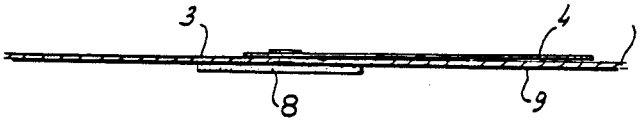
Figure 5B:
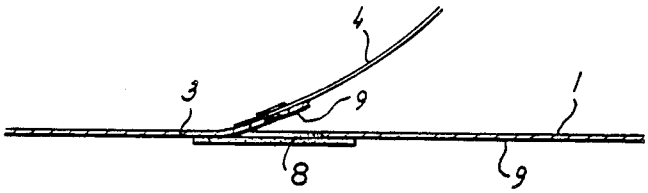

FIGS. 4, 5*a* and 5*b* show a preferred embodiment wherein the porous throttle device 8 is attached over its entire surface, for example by means of pressing on in the warmed state or by pouring on as a liquid and curing so that it becomes solid, bonded to a known plastic protective layer 9 located on the inside of the end face 1. The strength of adhesion is such that the throttle device comes away from the lip closure 4 and the coating 9 when this is torn away (FIG. 5*b*).

Figure 6A:
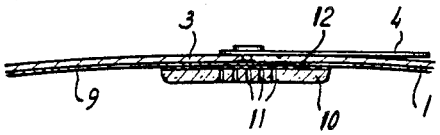
Figure 6B:
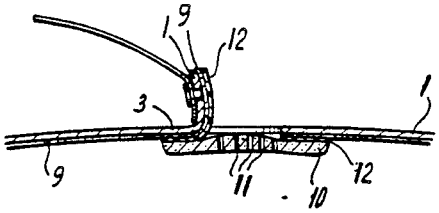

FIGS. 6*a–b* show yet another preferred embodiment in which the throttle device consists of two layers attached to one another: a layer 10 with holes 11, the diameter of which is shown in exaggerated form, and a solid layer 12. The solid layer 12 is attached to the inside of the end face 1 such that when the lip 3 is torn away the solid layer 12 is pulled off the perforated layer, so that the internal excess pressure can drop. This embodiment of the throttle device can also be attached to the end face by pressing on in the warmed state, or poured on as a liquid which is cured and forms a solid bonded to the coating. As an alternative, layers 10 and 12 could consist of one piece of material, the line 12 depicting the part which is strongly bonded to the coating.

Figure 7A:
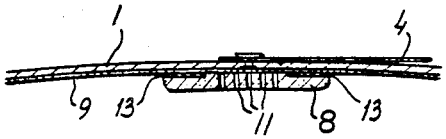
Figure 7B:
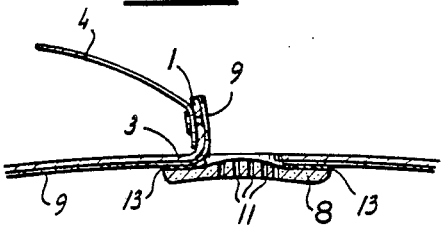

FIGS. 7*a–b* show a preferred embodiment of a single layer throttle device 8, provided with holes. This throttle device is attached to the inside of the end face 1 only at its circumference region 13. The internal excess pressure can drop as soon as the lip closure 3 is slightly torn away.

Figure 8:
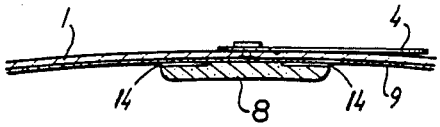

FIG. 8 shows a throttle device 8 which is provided with small channels 14 on the surface which faces towards the inside of the end face. These small channels 14 have the same function as the holes 11 in FIGS. 6 and 7. As soon as the lip closure has been slightly torn away the pressure can drop via these small channels 14.

Figure 10:
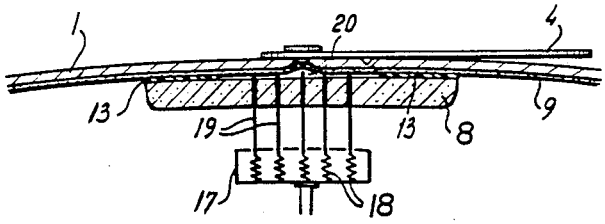
FIG. 10 shows a procedure for producing a lip closure with holes.
Figure 9A:
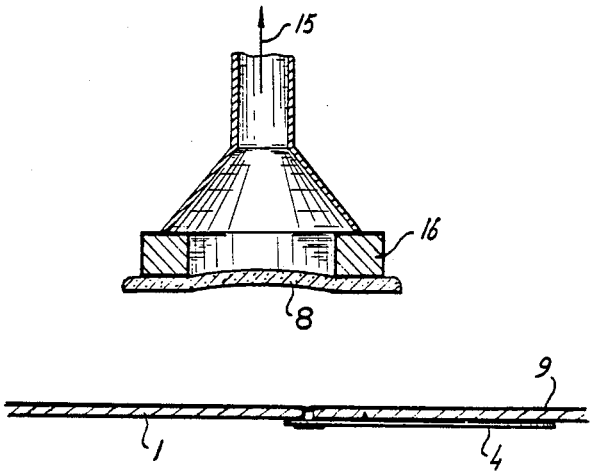
Figure 9B:
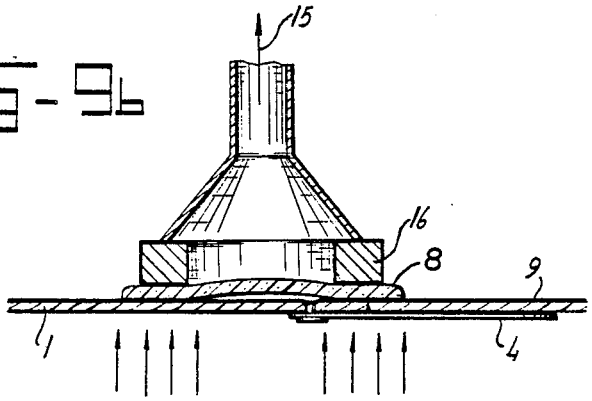

FIGS. 9 and 10 show procedural steps for attaching the throttle device 8 according to FIGS. 7*a–b*. The throttle device 8, which may or may not be already provided with holes, is held firmly on a press-on device 16 by an underpressure 15 (FIG. 9*a*). The outside of the end face 1 is locally heated, after which the throttle device is pressed onto the heated plastic coating 9 of the face 1 by press-on device 16. Holes are then made in the throttle device 8 attached in this way by means of a tool with needles 19 supported by means of springs 18. At 20 there is a depression in the end face formed by the head of the rivet with which the lip closure is attached.

As can be seen from these figures, the throttle device is arched slightly away from the end face by the underpressure. By this means it is ensured that with this embodiment the throttle device is attached only in its edge region to the end face 1.

Figure 11:
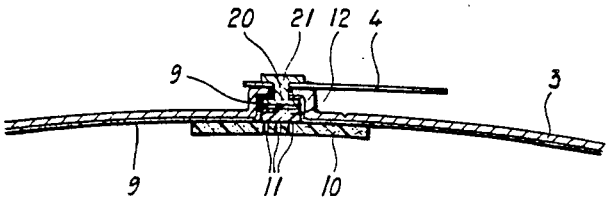
FIG. 11 shows a detail of the end face.

In FIG. 11 the attachment of the ring pull 4 to the lip closure 3 is shown in detail. In this case the throttle device consists of two layers, i.e. a solid layer 12, which is present only in the hollow 20, and the layer 10 provided with holes. The holes can be in the region which is covered by the solid layer 12, which is pulled with the lip closure when this is pulled away and thus exposes the holes. Here as well, layers 10 and 12 could consist of one piece of material. Part 12 is being torn away upon opening.

Figure 12:
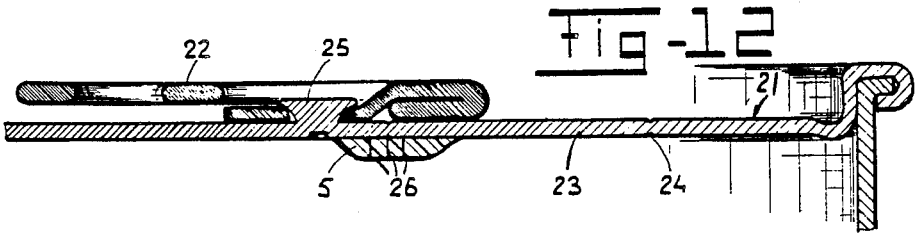
FIG. 12 shows another embodiment of the end face with an inwardly opening lip in closed condition.

The end face 21 in FIG. 12 is equipped with a modified ring pull 22 and lip closure 23. This modified arrangement has been introduced recently; its main advantage is that the lip closure 23 upon opening will not completely be separated from the end face. To this end the weakening line 24 is not completely surrounding the lip closure 23. Therefore, the lip closure 23 stays attached to the end face 21, which avoids the environmental problems associated with loose lip closures. In its opened condition, the lip closure 23 is situated within the can, without obstructing the pour opening.

Figure 13:
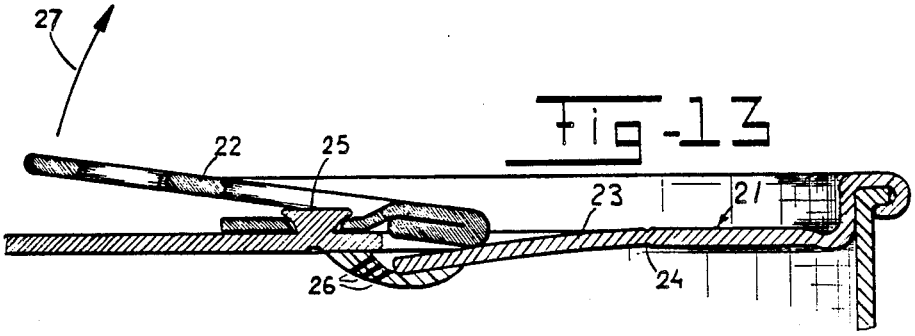
FIG. 13 shows the end face according to FIG. 12 during the first phase of opening.
Figure 14:
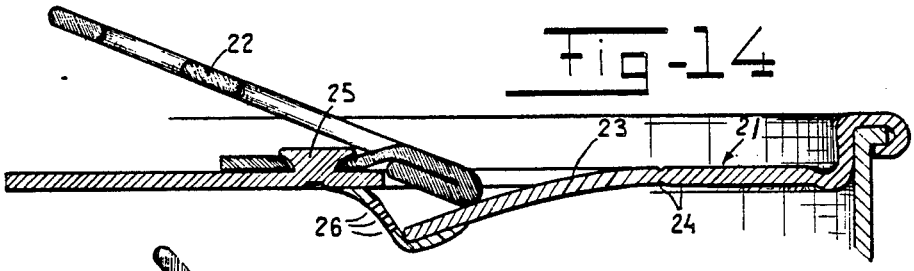
FIG. 14 shows the end face according to FIG. 12 with the lip being pushed further open.
Figure 15:
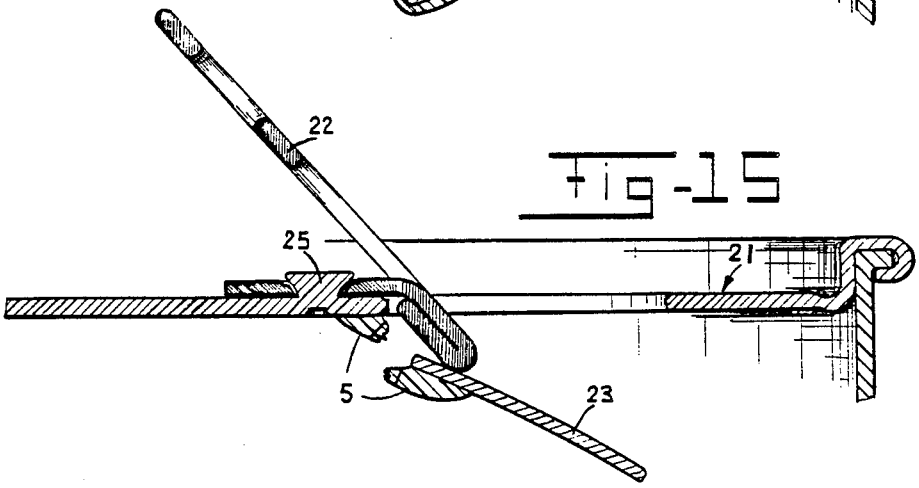
FIG. 15 shows the end face according to FIG. 12 with the lip completely opened.

In this embodiment too, a throttle device 5 is fitted on the section of the lip closures 23 and the adjacent inside of the end face 21 close to the ring pull 22. As in the former arrangement, the lip closure 23 is partially torn away during the first stage of opening. However, as shown in FIG. 13, due to the pivoting movement of the ring pull 22 around its attachment 25 to the end face 21, the lip closure is being pushed inwardly. The throttle device 5, which is firmly attached to both the end face 21 and the lip closure 23, is forced to follow this movement and stretches. The size of the tiny holes 26 formed in the throttle device 5 is therefore increased. Via these holes the excess gas under pressure in the can can be released gradually. If, however, the pressure is relatively high and the outflow of gas is too fast, the venting of the can may be reduced by removing the opening force 27 on the ring pull 22. Due to the elastic character of the throttle device 5 it therefore contracts, which leads to a reduction of the size of holes 26. Subsequently the lip closure 23 may be opening further, as shown in FIG. 14, and the throttle device 5 folds back or breaks and the lip closure may be pushed inwardly in the known way (FIG. 15).

According to another embodiment the throttle device may consist of a material with an open-cell structure which is porous. In this case no holes need to be manufactured to obtain the desired throttle effect.

Both embodiments are advantageous in that the remnants of the throttle device after opening the lip closure are barely discernable in the inside of the can. Therefore, the throttle device is less likely to raise objections from an esthetic point of view.

I claim:

1. End face for a can which can be under excess pressure on the inside and which is provided with a tear-away lip closure, provided with a throttle device for controlled release of the excess pressure on tearing open the lip closure characterized in that the throttle device is connected to the inner region of the end face close to the section of the lip closure which is torn open first, and also to the region of the lip closure bordering said end face section so as to provide a seal.

2. End face according to claim 1 characterized in that said throttle device is impermeable and provides a plurality of throttle passages located between the surfaces of said throttle device and at least one of said end face section or said lip closure region.

3. End face according to claim 1 characterized in that said throttle device is permeable as a result of a plurality of holes provided therein.

4. End face according to claim 3 characterized in that said throttle device is attached to said lip closure and the end face, said throttle device having a boundary layer attached thereto, and said plurality of holes terminates a short distance from said lip closure such that when said lip closure is torn open said boundary layer of said throttle device is pulled with it and said plurality of holes comes into contact with the atmosphere.

5. End face according to claim 4 characterized in that the throttle device consists of a first layer provided with a plurality of holes and a solid second layer which is attached thereto and is also attached to the tear-away lip, such that when the tear-away lip is torn open said solid second layer is pulled with the tear-away lip.

6. End face according to claims 3, 4 or 5 characterized in that the throttle device consists of a material with elastomeric elastic-plastic properties.

7. End face according to claim 6 provided with a tear-away lip closure of the kind which upon opening is being pushed into the inner space of the can characterized in that the attachment of the material of said throttle device to the corresponding surfaces of said lip closure and the end face is strong enough to permit stretching of the material of said throttle device during the first stage of opening of the lip closure.

8. End face according to claim 3 characterized in that said throttle device consists of two layers which are connected to one another at the periphery of said connected regions and have holes which do not lie in an overlying relationship.

9. End face according to claim 8 characterized in that the one of said two layers adjoining the end face has a larger number of holes than the other one of said two layers.

* * * * *

UNITED STATES PATENT AND TRADEMARK OFFICE

CERTIFICATE OF CORRECTION

PATENT NO. : 4,928,845

DATED : May 29, 1990

INVENTOR(S) : Michael J. M. Doyle

It is certified that error appears in the above-identified patent and that said Letters Patent is hereby corrected as shown below:

Front page, in the Inventor: information "3D" should read --JD--.

Front page, Foreign Application Priority Data number "8705497" should read --8702497--.

Signed and Sealed this

Sixth Day of August, 1991

*Attest:*

HARRY F. MANBECK, JR.

*Attesting Officer*

*Commissioner of Patents and Trademarks*